US008240775B2

(12) United States Patent
Rothery

(10) Patent No.: US 8,240,775 B2
(45) **Date of Patent: *Aug. 14, 2012**

(54) NON-MOTORIZED GOLD MINING APPARATUS

(76) Inventor: Brian Rothery, Rocklin, CA (US)

( * ) Notice: Subject to any disclaimer, the term of this patent is extended or adjusted under 35 U.S.C. 154(b) by 325 days.

This patent is subject to a terminal disclaimer.

(21) Appl. No.: 12/573,748

(22) Filed: Oct. 5, 2009

(65) Prior Publication Data

US 2010/0019562 A1 Jan. 28, 2010

Related U.S. Application Data

(63) Continuation-in-part of application No. 11/706,492, filed on Feb. 15, 2007, now Pat. No. 7,597,401.

(51) Int. Cl.
*E21C 41/22* (2006.01)

(52) U.S. Cl. ..... 299/8

(58) Field of Classification Search ..... 299/8, 9
See application file for complete search history.

(56) References Cited

U.S. PATENT DOCUMENTS 539,463 A 5/1895 Whaler
906,234 A 12/1908 Jackson
1,490,016 A 4/1924 MacKenzie
1,596,448 A 8/1926 Parker
2,073,122 A 3/1937 Silke
2,756,977 A 7/1956 Temple
3,558,043 A 1/1971 Smith et al.
3,950,246 A 4/1976 Klefisch
4,264,105 A 4/1981 Thompson
4,367,989 A 1/1983 Smith
4,494,986 A 1/1985 Forsman
7,597,401 B2 * 10/2009 Rothery ..... 299/8

* cited by examiner

*Primary Examiner* — John Kreck

(74) *Attorney, Agent, or Firm* — Edwin Tarver

(57) ABSTRACT

A non-motorized apparatus for collecting particulate materials, including gold, in stream placer deposits, comprising a first tubular member, a second tubular member, a riffle tray with perforated ridges, a skirt for enveloping the tubular members and directing stream flow, and a fibrous matting held entirely inside the second tubular member. The second tubular member is connected to one end of the first tubular member in a way that a high velocity stream flowing into the first tubular member creates suction pressure in the second tubular member. The particulate matter settles in grooves formed by the ridges in the riffle tray and passes through perforations to become trapped in the fibrous matting as the stream is drawn into the second tubular member.

20 Claims, 4 Drawing Sheets

NON-MOTORIZED GOLD MINING APPARATUS

This application is a continuation in part of U.S. patent application Ser. No. 11/706,492, filed on Feb. 15, 2007 now U.S. Pat. No. 7,597,401.

BACKGROUND

The present invention relates in general to mining apparatuses, and more particularly to a non-motorized gold mining apparatus for mining gold from stream placer deposits.

A variety of apparatuses for extracting fine particulate matter, including gold and other valuable materials, from streams, rivers or rock crevices have been developed in the art. U.S. Pat. No. 2,756,977 to Temple discloses a device for recovering gold from streams. The device includes a tubular conveyor comprising digging means in the form of teeth or plates at the lower end and a centrally disposed water line and air pressure line for discharging pressurized water and air to the digging member. The water and air discharged to the digging member is then adapted to move upwards through the conveyor for delivering into the collector receptacle where the water is discharged through the plurality of openings and heavy metals settle in the lower portion of the collector.

U.S. Pat. No. 4,367,989 to Smith discloses a portable gold mining apparatus collecting particulate gold bearing material from rock crevices. The apparatus includes a gas engine driven air blower having shoulder straps for mounting on the back of a user. The air blower includes flexible duct connected to an elongated flexible conduit having a nozzle or crevice tool connected to the conduit front end and a container having an air outlet connected to the rear end of the conduit. The air blown into the conduit provides jet pump action to suck particulate gold bearing material to the container from the conduit front end. However, unlike the present invention, both the Smith and Temple apparatuses utilize pressurized air for sucking the medium rich in particulate matter.

U.S. Pat. No. 2,073,122 to Silke discloses a portable placer mining device designed to be operated on the bed of stream or river to recover valuable minerals such as gold, silver and platinum. The device doesn't use power and is adapted to be anchored in the river or stream. The device utilizes water current to create sufficient suction to draw sand and gravel from the river or stream into a sluice box. The flow of the water washes sand and gravel through the sluice box provided with riffles or matting for trapping valuable minerals and the sand and gravel is carried back to the stream. However, the means for collecting the particulate matter and the structure associated which has no moving parts that are sensitive to extreme temperatures and corrosion. These and other objects of the present invention will become better understood with reference to the appended Summary, Description and Claims.

SUMMARY

The present invention is a non-motorized mining apparatus for extracting gold and other valuable minerals from stream placer deposits. The apparatus comprises two hollow members, a riffle tray, fibrous matting and a skirt made of non-permeable flexible fabric for diverting water into the tubular members. One end of the first hollow member is connected to the second hollow member. The second hollow member is designed to create a Venturi space at the interface with the first hollow member. The riffle tray and fibrous matting are incorporated into the second hollow member for trapping particulate matter. Although the riffle tray and fibrous matting are incorporated into the second hollow member, they may also be disengaged from the second hollow member. The skirt is clamped around the exit of the first hollow member and left unclamped at the other end which widens and directs the stream into the hollow members.

The entrance of the second hollow member is connected to a flexible hose for gathering stream bed deposits. Because of the Venturi effect, the stream enters the first hollow member at high velocity. As it exits the first hollow member, it causes suction pressure in the second hollow member. Particulate matter carried into the second hollow member gets collected in the riffle tray and fibrous matting. The particulate matter can be extracted by detaching the second member from the apparatus and fibrous matting.

DESCRIPTION

Figure 1:
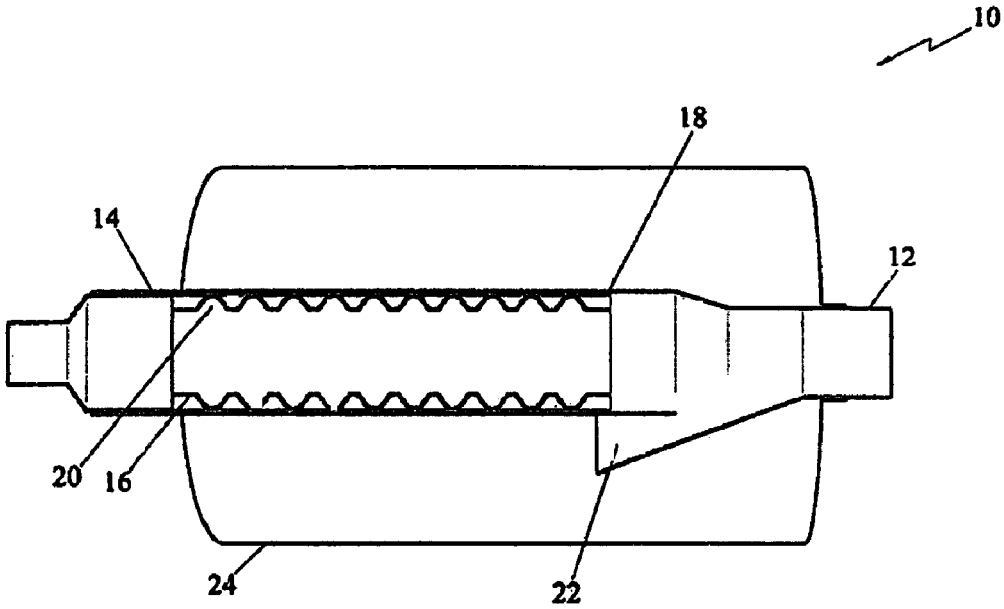
FIG. 1 is a cross-sectional view of the non-motorized gold mining apparatus of the present invention.

Referring to FIG. 1, the apparatus 10 comprises a first hollow member 12, a second hollow member 14, a riffle tray 16, a fibrous matting 18, at a skirt 24 for enveloping the tubular members and directing water through them. The hollow members are made of rigid material, and in preferred embodiments are tubular and can be disconnected and reassembled. The first hollow member includes an opening 22 that causes a Venturi effect in the stream flow. In a preferred embodiment, the Venturi effect is caused by a conical portion of the first hollow member oriented relative to the second hollow member so as to create a decreasing space as the stream enters the opening 22 and travels through the first member 12, thereby accelerating the stream velocity.

Figure 2:
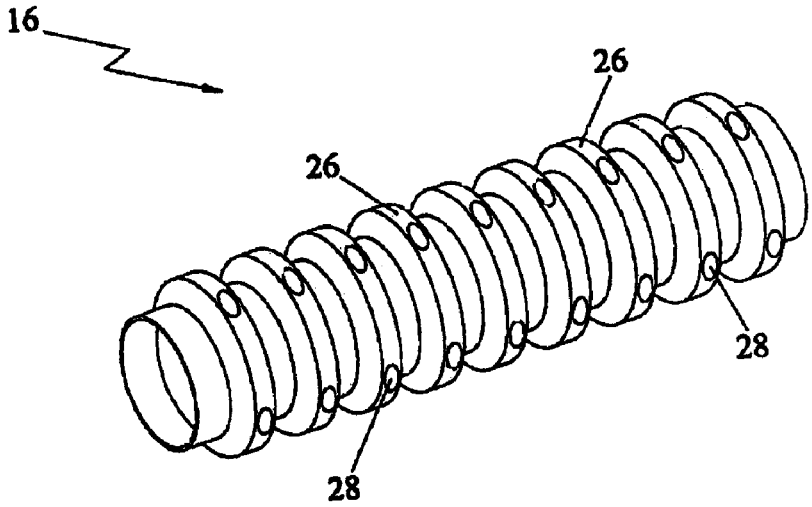
FIG. 2 is a perspective view of the riffle tray.

The riffle tray 16 is essentially a hollow space through which the stream also passes. The riffle tray 16 presents an increased surface area to the stream by virtue of grooves 20 on its inner surface. Referring to FIG. 2, a close-up view of one preferred embodiment of the riffle tray 16 is shown. In this embodiment, the exterior of the riffle tray shows the ridges 26 that correspond to the grooves on the inner surface. In another preferred embodiment, the riffle tray 16 comprises a series of perforations 28 at the apex of the ridges. The perforations allow material to travel into the fibrous matting that surrounds the riffle tray when assembled.

Figure 3:
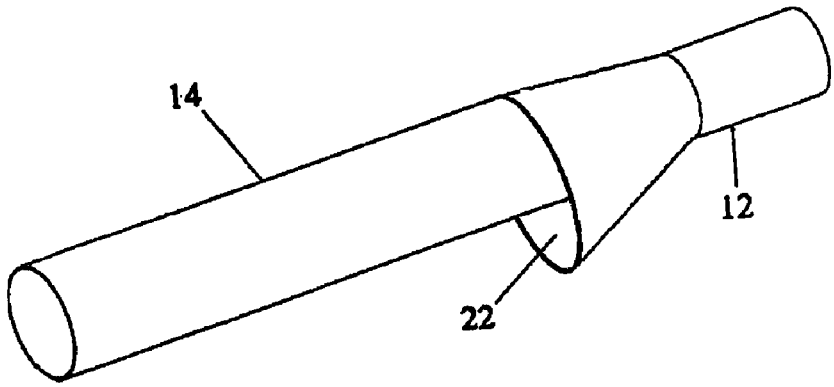
FIG. 3 is a perspective view of the first and second hollow members when attached.

Referring to FIG. 3, a perspective view of the assembled first and second tubes is shown. The first tube 12 comprises a conical section 22 into which the second tube is inserted. With the skirt anchored around the first tube 12, stream water is forced under pressure through the decreasing conical space. Downstream pressure out of the first member 12 builds up suction in the second member 14, which draws in stream water containing particulate matter that settles in the second member 14.

Figure 4:
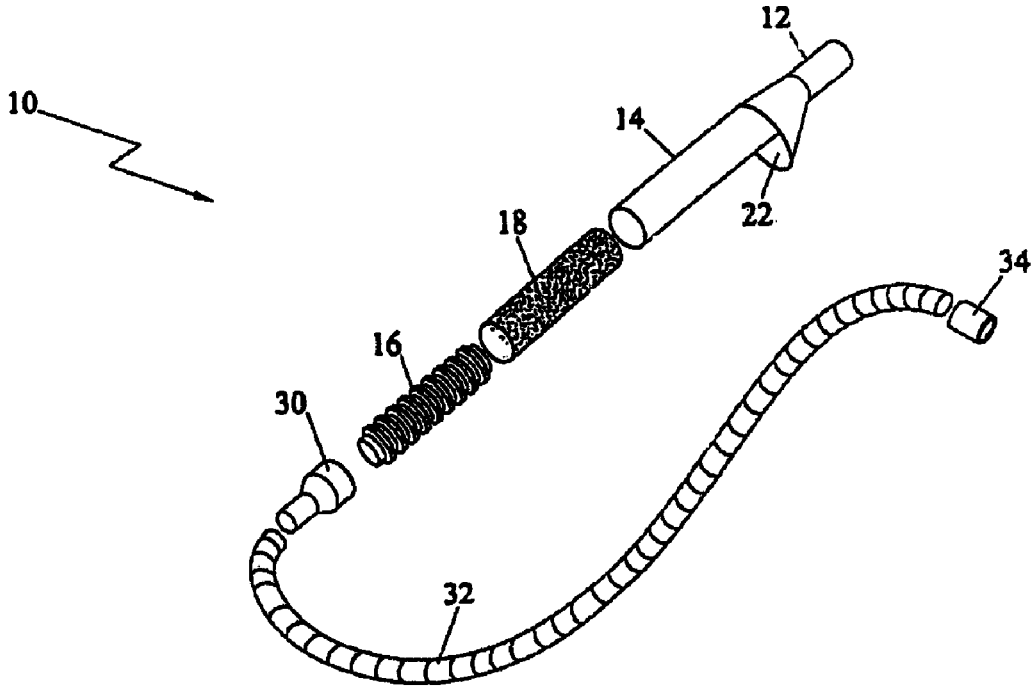
FIG. 4 is an exploded view of the apparatus, without the skirt.

Referring to FIG. 4, a perspective exploded view of the first member 12, second member 14, riffle tray 16, and fibrous matting 18 is shown with an end cap 30 to the entrance of the second member 14 attached to a flexible hose 32 and a nozzle 34. The flexible hose 32 and nozzle 34 allows a user to investigate stream deposits over a wide area without disturbing the flow of water through the device 10.

Figure 5:
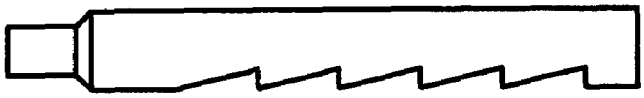
FIGS. 5 through 7 are side views of various embodiments of the second hollow member incorporating a riffle tray.
Figure 6:
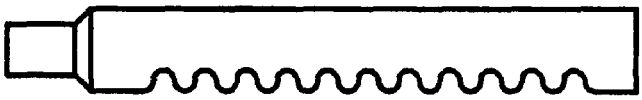
Figure 7:
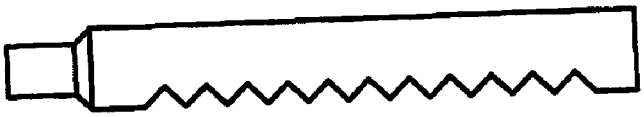
Figure 8:
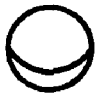
FIG. 8 is a front view of the second hollow member according to the various embodiments of FIGS. 5 through 7.
Figure 9:
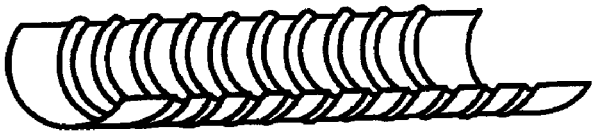
FIG. 9 is a perspective view of a removable riffle tray.
Figure 10:
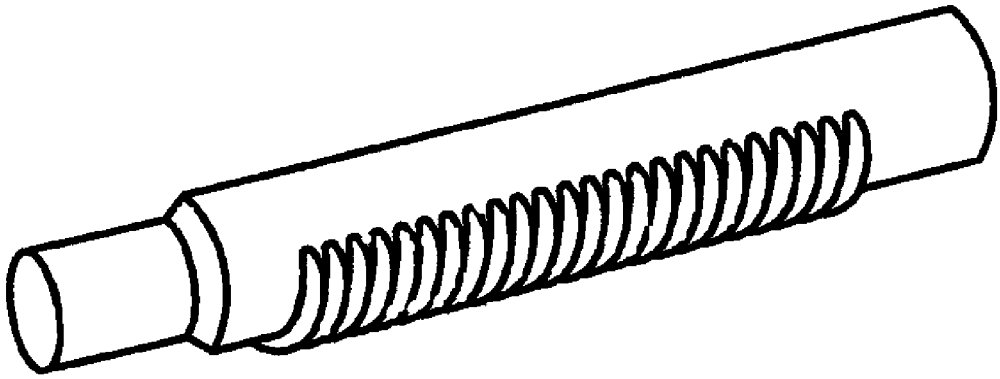
FIG. 10 is a perspective view of a second hollow member also functioning as a riffle tray.

The riffle tray of the device may take a variety of forms. Although a ridge and groove cross-sectional pattern is contemplated, other subtleties may be incorporated into the pattern. FIGS. 5, 6 and 7 show second hollow members exhibiting different riffle tray shapes: FIG. 5 shows a saw wave pattern; FIG. 6 shows a conventional sin wave; and FIG. 7 shows a triangle wave pattern. Also as shown in FIGS. 5 through 7, the riffle tray may only occupy a bottom section of the second hollow member. In these cases, fluid moving through the second hollow member will exhibit convection currents as the portion of the fluid encountering the riffle tray slows relative to the fluid as a whole. A front view of this arrangement can be seen in FIG. 8. Other embodiments of the invention contemplate the riffle tray as a removable part, and as both a flat surface as well as semi-circular in profile as shown in FIG. 9. In certain preferred embodiments, the second hollow member may comprise the riffle tray. An example of this arrangement can be seen in FIG. 10. Any embodiment that produces drag on the stream flow through the second hollow member can be incorporated into the invention.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A non-motorized apparatus for collecting particulate materials, including gold, in stream placer deposits, comprising:

a. a first tubular member with a first inlet, a second inlet, and an outlet;

b. a second tubular member having at least one corrugation in the tube wall, the corrugation retaining particulate matter of a predetermined specific gravity attached to the second inlet of the first tubular member such that a high velocity stream flowing through the first inlet of the first tubular member creates a suction pressure in the second tubular member; and c. a skirt enveloping the tubular members and directing stream flow into the first tubular member.

2. The apparatus of claim 1, wherein the first inlet of the first tubular member comprises a conical section, and the outlet comprises a uniform tubular section having a constant diameter.

3. The apparatus of claim 2, wherein the first end of the second tubular member forms a Venturi effect inducing space between the outer surface of the second tubular member and the inner surface of the first inlet of the conical section.

4. The apparatus of claim 3, wherein the second tubular member is detachably connected to the first tubular member.

5. The apparatus of claim 3, wherein the end of the second tubular member opposite the first tubular member is connected to a flexible hose.

6. The apparatus of claim 3, wherein the stream enters the first tubular member through the conical section, which increases the velocity of the steam and creates suction pressure through the second tubular member.

7. The apparatus of claim 1, wherein the skirt enveloping the tubular members comprises a non-permeable and flexible material.

8. The apparatus of claim 7, wherein one end of the skirt is attached around the circumference of the first tubular member and the other end of the skirt is open to receive the stream.

9. The apparatus of claim 1, wherein the tubular members and skirt can be disassembled and reassembled.

10. The apparatus of claim 1, wherein particulate matter having a higher specific gravity settles and is collected on the corrugated surface within the second tubular member.

11. The apparatus of claim 10, wherein particulate matter is extracted by detaching the first and second tubular members.

12. A non-motorized gold mining apparatus for collecting particulate matter, including gold in stream placer deposits comprising:

a. a first tubular member having a first entrance, a conical second entrance and an exit;

b. a second tubular member with an exit attached to the second entrance of the first tubular member to create a Venturi effect between the outer surface of the second tubular member and the inner surface of the first entrance of the first tubular member, and an entrance, wherein a high velocity stream flowing into the first entrance of the first tubular member creates a suction pressure in the entrance of the second tubular member;

c. a skirt made of non-permeable flexible fabric enveloping the tubular members and causing the stream to flow into the first tubular member; and d. a riffle tray within the second tubular member configured to selectively retain particulate matter of a predetermined specific gravity.

13. The apparatus of claim 12, further comprising a flexible hose with two ends, wherein a nozzle is affixed to the first end of the hose and the second end of the hose is connected to the second tubular member.

14. The apparatus of claim 12, wherein the riffle tray, tubular members and skirt can be disassembled and reassembled.

15. The apparatus of claim 12, wherein the riffle tray is flat.

16. The apparatus of claim 12, wherein the riffle tray is curved.

17. The apparatus of claim 12, wherein the riffle tray is tubular.

18. The apparatus of claim 12, wherein a section of the second tubular member forms the riffle tray.

19. The apparatus of claim 18, wherein the riffle tray comprises fibrous matting.

20. A non-motorized apparatus for collecting particulate materials, including gold, in stream placer deposits, comprising:

a. a first hollow member with a first entrance, second entrance and at least one exit;

b. a second hollow member adapted to attach to the second entrance of the first member;

c. a skirt directing stream flow into the first entrance of the first member; and d. an irregular surface within the second hollow member that creates one or more regions of reduced stream velocity, allowing heavier particles to become trapped in the second hollow member.

* * * * *